US009089992B2

(12) United States Patent
Domey et al.

(10) Patent No.: US 9,089,992 B2
(45) Date of Patent: Jul. 28, 2015

(54) METHODS AND APPARATUS FOR MAKING HONEYCOMB STRUCTURES WITH CHAMFERED AFTER-APPLIED AKIN AND HONEYCOMB STRUCTURES PRODUCED THEREBY

(75) Inventors: Jeffrey J. Domey, Elmira, NY (US); John E. Graham, Corning, NY (US); Dale R. Hess, Corning, NY (US); Christopher J. Malarkey, Corning, NY (US)

(73) Assignee: Corning Incorporated, Corning, NY (US)

( * ) Notice: Subject to any disclaimer, the term of this patent is extended or adjusted under 35 U.S.C. 154(b) by 1772 days.

(21) Appl. No.: 11/796,952

(22) Filed: Apr. 30, 2007

(65) Prior Publication Data

US 2008/0268200 A1 Oct. 30, 2008

(51) Int. Cl.

| | |
|---|---|
| ***B28B 7/00*** | (2006.01) |
| ***B28B 19/00*** | (2006.01) |
| ***B28B 11/12*** | (2006.01) |

(52) U.S. Cl.

CPC ..... *B28B 19/0038* (2013.01); *B28B 7/0085* (2013.01); *B28B 11/12* (2013.01); *Y10T 428/24149* (2015.01)

(58) Field of Classification Search

CPC ..... B28B 19/0038
USPC ..... 427/356; 502/439
See application file for complete search history.

(56) References Cited

U.S. PATENT DOCUMENTS

| | | | | |
|---|---|---|---|---|
| 4,767,309 | A | 8/1988 | Mizuno et al. | 425/461 |
| 4,882,878 | A * | 11/1989 | Benner | 451/541 |
| 5,009,038 | A * | 4/1991 | Yoshikawa et al. | 451/11 |
| 5,185,113 | A | 2/1993 | Seyer et al. | 264/67 |
| 5,209,525 | A | 5/1993 | Ito | 285/137.1 |
| 5,219,667 | A | 6/1993 | Hampton | 428/593 |
| 5,316,710 | A | 5/1994 | Tasaki et al. | 264/57 |
| 6,287,103 | B1 | 9/2001 | Miyazaki | 425/131.1 |
| 6,338,826 | B2 | 1/2002 | Yamada et al. | 422/180 |
| 6,607,173 | B2 * | 8/2003 | Westmoreland | 249/114.1 |
| 6,776,689 | B2 * | 8/2004 | Eichelberger | 451/8 |
| 6,953,493 | B2 | 10/2005 | Nakayama et al. | 95/51 |
| 7,014,680 | B2 | 3/2006 | Nakayama et al. | 95/51 |
| 2001/0051117 | A1 | 12/2001 | Yamada et al. | 422/180 |
| 2002/0100994 | A1 * | 8/2002 | Sander | 264/102 |
| 2005/0016140 | A1 | 1/2005 | Komori et al. | 55/523 |
| 2005/0129590 | A1 | 6/2005 | Ichikawa et al. | 422/180 |
| 2005/0180898 | A1 | 8/2005 | Yamada et al. | 422/180 |
| 2005/0249877 | A1 * | 11/2005 | Noro et al. | 427/289 |
| 2006/0021310 | A1 | 2/2006 | Ohno et al. | 55/523 |
| 2006/0029769 | A1 | 2/2006 | Ichikawa et al. | 428/116 |
| 2006/0068159 | A1 | 3/2006 | Komori et al. | 428/116 |
| 2006/0165956 | A1 * | 7/2006 | Souda | 428/116 |

(Continued)

FOREIGN PATENT DOCUMENTS

| | | |
|---|---|---|
| EP | 0195621 B1 | 6/1991 |
| JP | 2002-018290 | 1/2002 |

*Primary Examiner* — Tabatha Penny
(74) *Attorney, Agent, or Firm* — Susan S. Wilks

(57) ABSTRACT

Methods of manufacturing a honeycomb structure comprise the step of providing a honeycomb body having a multiplicity of cells extending therethrough between opposing end faces. The cells are defined by intersecting porous walls. The methods further include the steps of applying an after-applied skin layer on the honeycomb body and chamfering an edge of the after-applied skin. The chamfering step is performed on a wet after-applied skin layer.

26 Claims, 5 Drawing Sheets

(56) References Cited

U.S. PATENT DOCUMENTS

2006/0168927 A1 8/2006 Watanable ..... 55/523
2006/0194018 A1 8/2006 Ohno et al. ..... 428/116
2006/0289501 A1 12/2006 Michiwaki et al. ..... 219/687
2006/0292333 A1* 12/2006 Ohno et al. ..... 428/116
2006/0292334 A1 12/2006 Ohno et al. ..... 428/116

* cited by examiner

METHODS AND APPARATUS FOR MAKING HONEYCOMB STRUCTURES WITH CHAMFERED AFTER-APPLIED AKIN AND HONEYCOMB STRUCTURES PRODUCED THEREBY

TECHNICAL FIELD

The present invention relates to honeycomb filter articles, methods of manufacturing and apparatus for manufacturing the same. More particularly, the present invention methods and apparatus for manufacturing honeycomb filters where an after-applied skin layer has been chamfered or shaped to provide protection from chipping and flaking damage at the edges of the honeycomb structures.

BACKGROUND OF THE INVENTION

Diesel engines provide lower emissions and increased fuel economy compared to gasoline engines; however, untreated diesel exhaust emissions are generally undesirable. Diesel particulate filters have been employed to control/treat particulate emissions from diesel-powered equipment such as trucks, buses, diesel powered ships, diesel electric locomotives and generators. Diesel particulate filters control diesel particulate emissions by physically trapping soot particles in their structures.

A typical diesel particulate filter body may be, for example, a honeycomb structure having a matrix of intersecting thin, porous walls that extend across and between its two opposing open end faces and form a large number of adjoining hollow passages, or cells, which also extend between and are open at the end faces. To form a filter, a first subset of cells is closed at one end face, and the remaining cells are closed at the other end face. A contaminated gas is brought under pressure to one face (the "inlet face") and enters the filter body via the cells that are open at the inlet face (the "inlet cells"). Because the inlet cells are sealed at the remaining end face (the "outlet face") of the body, the contaminated gas is forced through the thin, porous walls into adjoining cells that are sealed at the inlet face and open at the opposing outlet face of the filter body (the "outlet cells"). The solid particulate contaminants in the exhaust gas (such as soot), which are too large to pass through the porous openings in the walls, are left behind, and cleaned exhaust gas exits the outlet face of the filter body through the outlet cells.

Such diesel filters are typically formed by an extrusion process where a ceramic material is extruded into a green form before the green form is fired to form the final ceramic material of the filter. These extruded green forms can be any size or shape.

Green, unfired ceramic forms, as well as fired ceramic forms are readily damaged in the course of handling these objects during and after manufacture. Damage often occurs on the edges of these forms due to the mechanical stresses of contacting the forms with surfaces. Chipped and damaged forms are a significant source of handing losses in manufacturing plants and in the supply chain.

Accordingly, providing ceramic honeycomb structures which are less susceptible to mechanical damage is desired. Likewise, methods of manufacturing ceramic honeycomb structures which are less susceptible to mechanical damage are also desired.

SUMMARY OF THE INVENTION

Embodiments of the present invention provide methods and apparatus for manufacturing honeycomb filter structures having after-applied skin with a chamfered edge. Embodiments also include apparatus for forming the chamfered edge on after-applied skin of honeycomb filter structures. In addition, embodiments of the present invention provide honeycomb structures having chamfered after-applied skin.

In embodiments, the present invention provides methods for manufacturing honeycomb structures, with steps including: providing a honeycomb body having a multiplicity of cells extending along an axial direction between opposing end faces, the cells being defined by intersecting porous walls; applying an after-applied skin layer on the honeycomb body; and chamfering an edge of the after-applied skin where the chamfering step is performed on a wet after-applied skin layer. Embodiments of the present invention also include contouring the honeycomb body or matrix before applying the after-applied skin layer. In additional embodiments, the present invention provides chamfering tools which are contoured or straight, rigid or flexible blade or plate, or a contoured or straight roller bar.

In additional embodiments, the present invention provides methods of manufacturing honeycomb structures with shaped after-applied skin by placing at least one end face of a skinless honeycomb structure against a plate with a chamfer lip and applying after-applied skin. In embodiments, the plate may include non-stick or release material. Or, plates may have deformable material or may be rotated.

In more embodiments, the present invention provides methods of manufacturing honeycomb structures with after-applied skin including steps of applying an after-applied skin to a skinless honeycomb structure and pressing the honeycomb structure with after-applied skin against a press plate to form honeycomb structures with shaped or chamfered after-applied skins.

In further embodiments, the present invention provides methods for manufacturing honeycomb structures having after-applied skin with the steps of placing a honeycomb structure on a turntable, placing a chamfering tool having a substantially flat midsection and shaped ends adjacent to the skinless honeycomb structure, turning the turntable to rotate the honeycomb structure in relation to the chamfering tool while applying skin material between the surface of the rotating honeycomb structure and the chamfering tool, resulting in a layer of skin material having a substantially flat midsection and chamfered ends.

In still further embodiments, the present invention provides apparatus for manufacturing honeycomb structures which have a chamfering tool to form a chamfered edge on wet after-applied skin, and a turntable. In embodiments, the chamfering tool can be a rigid or flexible, shaped or flat blade. In other embodiments, the present invention provides apparatus to apply an after-applied skin and chamfer the edge of the after-applied skin in a single manufacturing step.

In embodiments, the present invention also provides honeycomb structures which have a matrix with a multiplicity of cells extending along an axial direction of the honeycomb structures, between opposing end faces, and an after-applied skin layer which has a chamfered edge. In embodiments, the end face of the matrix may be at a 90° angle to the axial direction of the honeycomb structure. The chamfer on the after-applied skin layer may originate at the intersection point of the after-applied skin and the end face of the honeycomb structure. In embodiments, the matrix may not be chamfered. In additional embodiments, the matrix may be dried or fired and the after applied skin may be wet.

These, as well as other aspects and advantages of the present invention will become more apparent after careful consideration is given to the following detailed description of the preferred exemplary embodiments thereof in conjunction with the accompanying drawings.

DETAILED DESCRIPTION

Figure 1:
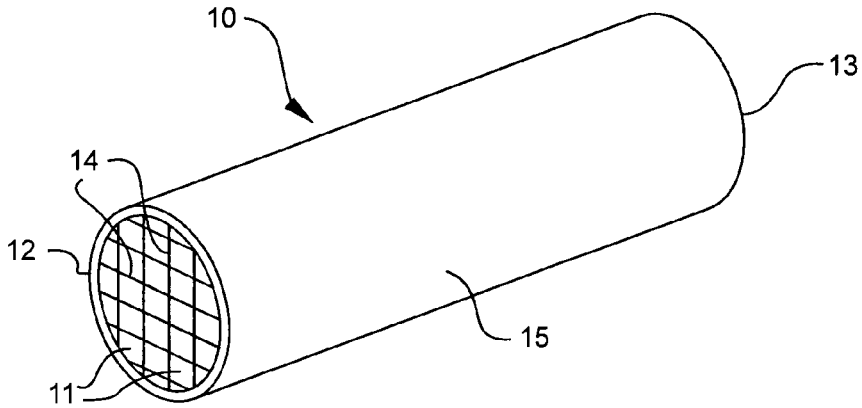
FIG. 1 is a perspective view of a typical solid particulate filter body fabricated using conventional methods.

Embodiments of the present invention provide methods for manufacturing honeycomb filter structures having after-applied skin with a chamfered edge. Embodiments also include an apparatus for forming the chamfered edge on after-applied skin of honeycomb filter structures. Another embodiment of the present invention provides a honeycomb filter having an after-applied skin with a chamfered edge formed on the end faces of the honeycomb filter structure.

Honeycomb diesel filters are designed to remove soot and other particulate matter from exhaust generated by diesel engines. Soot-laden gases disgorged from a diesel engine pass through the honeycomb filter and particulate matter suspended in the exhaust, including soot, becomes trapped in the walls of the honeycomb structure of the filter.

Typically, the honeycomb filter structure has a multiplicity of mutually adjoining cells extending along the axial direction of the filter, arranged in generally parallel columns between a pair of opposing end faces. The honeycomb structure is generally formed by thin intersecting porous walls extending between the end faces. Typically, the honeycomb filter will have an outer wall or outer skin layer extending between the end faces and bounding the rows of cells, defining the outermost wall of the filter structure, along the length of the filter.

Honeycomb structures for solid particulate filtering and other applications may be formed from a variety of porous materials including ceramics, glass-ceramics, glasses, metals, cements, resins or organic polymers, papers, or textile fabrics (with or without fillers, etc.), and various combinations thereof. Honeycomb structures having uniformly thin, porous and interconnected walls for solid particulate filtering applications are preferably fabricated from plastically formable and sinterable substances that yield a porous, sintered material after being fired to affect their sintering, especially metallic powders, ceramics, glass-ceramics, cements, and other ceramic-bases mixtures. According to certain embodiments, the structure may be formed from a porous ceramic material, such as silicon carbide, cordierite or aluminum titanate.

In an embodiment of the present invention, the honeycomb filter is made from cordierite—a synthetic ceramic composition of the formula applied $2MgO\text{-}2Al_2O_3\text{-}5SiO_2$. Cordierite has a very low thermal expansion coefficient, which makes the material resistant to extreme thermal cycling. It also exhibits high temperature resistance (~1200° C.) and good mechanical strength.

Typically, honeycomb filter structures are formed by an extrusion process where a ceramic material is extruded into a green form before the green form is fired to form the final ceramic material of the filter. These structures are extruded from molds and cut to create filter bodies shaped and sized to meet the needs of engine manufacturers. These extruded green forms can be any size or shape.

Generally, as a ceramic honeycomb filter structure is extruded, a solid external surface or skin is provided along the length of the filter structure, as a function of the extrusion process. Under certain circumstances, however, it becomes necessary to remove the external surface, or skin, from the filter structure. For example, in an embodiment of the present invention, a green ceramic honeycomb filter structure is extruded and then shaped to a desired shape and size, removing the extruded external skin of the honeycomb filter structure. In another embodiment, after a ceramic honeycomb filter structure is extruded, it is fired and then ground to a desired shape and size, removing the external skin of the honeycomb filter structure.

In an alternative embodiment, a ceramic honeycomb filter structure can be assembled from multiple honeycomb structures that are assembled together and affixed to each other to form a single ceramic honeycomb filter structure. These assembled honeycomb bodies can also be ground or cut to shape the honeycomb filter structure, removing the external skin of the honeycomb filter structure.

Referring now to the drawings, an exemplary solid particulate filter, after it has been extruded and fired, is shown in FIG. 1. The filter body comprises a honeycomb structure 10 having a multiplicity of hollow, open-ended passages or cells 11, which extend in a generally parallel fashion through the structure 10. The ends of the cells 11 are open, and form a pair of substantially identical open outer surfaces, at the opposing end faces 12, 13 of the structure 10. The cells 11 are themselves formed by a matrix of intersecting walls 14 that extend between each of the end faces 12, 13. For filter body applications, the walls 14 are porous and continuous across the end faces 12, 13 and preferably uniformly thin, although walls of non-uniform thickness may be used also. An outer wall 15 (or skin) extends between the end faces 12, 13 bounding the cells 11 and thin walls 14.

The honeycomb structure 10 may be formed of any cell (or channel) density, typically 100-350 cells per square inch. For the purpose of this application, the term "honeycomb" is intended to include materials having a generally honeycomb structure but is not strictly limited to a square structure. For example, hexagonal, octagonal, triangular, square, rectangular or any other suitable cell shape may be used.

Figure 2:
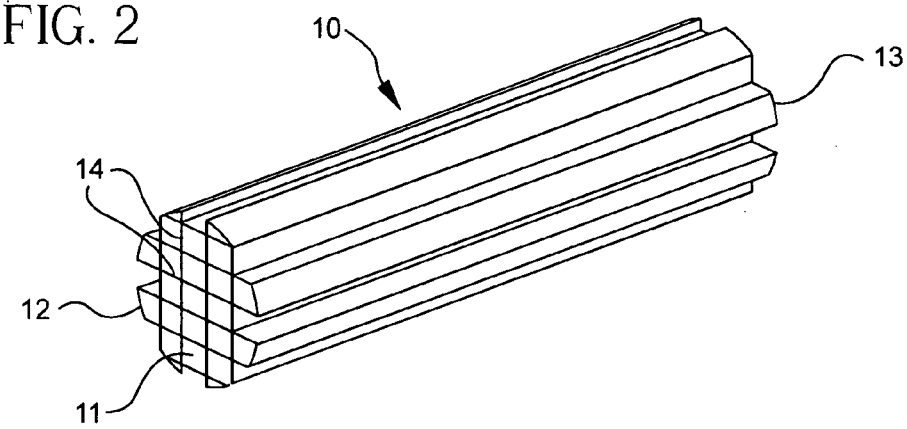
FIG. 2 is a perspective view of a honeycomb filter body after the exterior of the honeycomb filter body has been shaped and the outer skin removed.

The honeycomb structure can be contoured or shaped after it is extruded. FIG. 2 illustrates an embodiment of a honeycomb structure 10 after the filter body or matrix has been contoured. "Matrix" or "filter body" refers to the honeycomb structure without a skin. Shaping the filter structure removes an outer skin layer from the honeycomb filter body. Shaping can be accomplished by any means known in the art, including cutting or grinding away the exterior surface of the honeycomb structure until the desired shape and size is reached. The honeycomb structure 10 having a multiplicity of hollow, open-ended passages or cells 11 formed by a matrix of intersecting walls 14, and having opposing end faces 12, 13 is still intact. However, the outer wall or skin, as shown as 15 in FIG. 1, is no longer present. The exterior surface or skin of the honeycomb filter body can be removed from a green extruded ceramic or from a fired ceramic structure. The peripheral shape of the honeycomb structures may be any possible shape, for example, round, oval, and the like.

Figure 3:
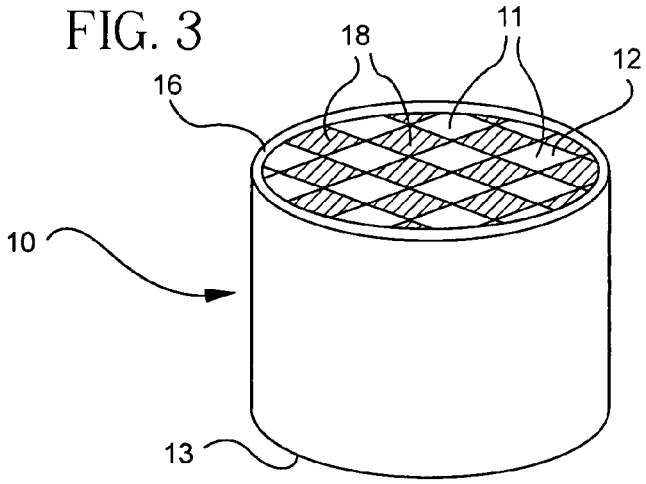
FIG. 3 illustrates an embodiment of the honeycomb filter body with an after-applied skin.

FIG. 3 illustrates a honeycomb filter structure that has been plugged. As seen in FIG. 3, alternate cells 11 of the honeycomb structure 10 have been blocked with plugs 18 at end faces 12, 13 preferably in a checked or checkerboard pattern. The plugging pattern on the end face 13 (hidden in FIG. 3) is the reverse of that depicted on the end face 12. The plugs 18 are selected from a material compatible with the composition of the honeycomb structure and its ultimate use as a filter body. The filter body may be formed from the honeycomb structure 10 by plugging, covering or otherwise blocking the open ends of a subset of cells at one end face 12 of the structure. Preferably, the remaining unblocked cells are plugged, covered or otherwise blocked at the remaining end face 13 of the structure. Selected cells are each plugged with a suitable plugging material, such as a sealant or cement mass, which extends from near the end faces 12, 13 a short distance into the cell 11, and is formed by passing the sealant or cement through, for example, a mask into the cell ends. After forming, the sealant or cement is cured by any method suitable for the particular material selected so as to form a seal that will substantially block the flow of the gas being filtered. Once the plugs are in place, the mask is removed. The result is an alternating pattern of plugs arranged on inlet end 12 and outlet end 13 so that exhaust gas flows into the filter body, into the filter cells that are not plugged at the inlet face, through the porous walls of cells 11, and out of the filter body through filter cells which are not plugged at the outlet face.

Figure 4:
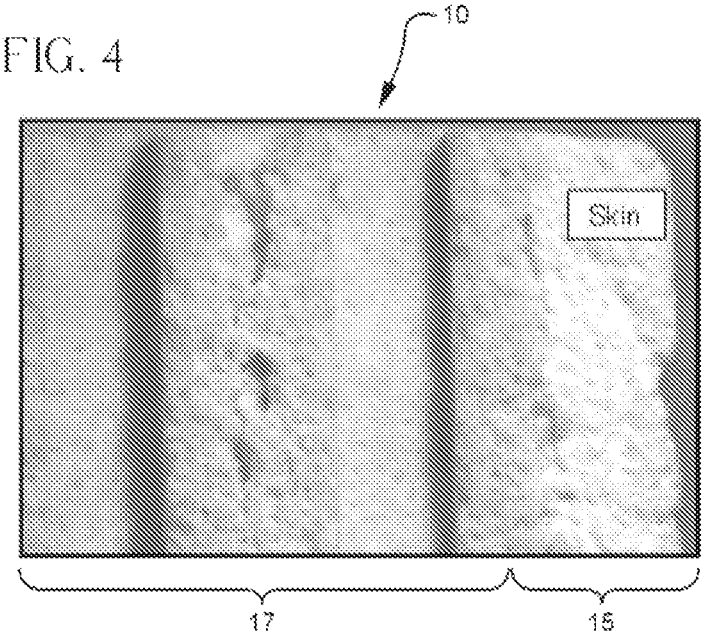
FIG. 4 is a photomicrograph showing a skin layer on a honeycomb filter body.

In an embodiment of the present invention, the honeycomb structure is dried and fired to sinter the ceramic material. These drying and firing steps may occur before or after the honeycomb filter body is shaped and/or plugged. After a ceramic honeycomb filter structure is shaped, dried and fired, a new external skin, an after-applied skin, is applied. FIG. 3 illustrates an embodiment of the honeycomb filter body 10 with an after-applied skin 16. FIG. 4 is a photomicrograph showing a skin layer 15 on a honeycomb filter body 17.

The after-applied skin 16, as shown in FIG. 3, can be of any material known in the art. In an embodiment, the after-applied skin is a material that is primarily cordierite, with organic and inorganic binder components. In an embodiment of the present invention, the after-applied skin 16 is applied to a honeycomb filter body after the honeycomb filter body has been fired and shaped to a desired shape and size. The after-applied skin 16 may be applied to the honeycomb filter body using techniques known in the art. Once the honeycomb filter body has been dried and fired, it may not be desirable to fire the sintered ceramic material again. Therefore, after-applied skin may not be fired at the same high temperature as the honeycomb filter body. Because it may not be fired in the same manner as the honeycomb filter body, this after-applied skin may be more susceptible to damage than the honeycomb filter body itself. As the filter body is handled, the after applied skin is subject to chipping or breaking, particularly at the end-faces or edges of the structure. For example, as a heavy filter body with an after-applied skin comes into contact with a surface, or slides across a surface, the edges of the after applied skin at the end faces may break, chip or flake. This may be particularly evident as large heavy filter bodies are manipulated by hand, and as the filter bodies proceed through the manufacturing process where the final filter products are assembled or canned. These edge chips, flakes or breaks create cosmetic issues at a minimum, and may affect the long term reliability of the filter product. Chipped and damaged forms are a significant source of handing losses in manufacturing plants and in the supply chain.

Figure 5:
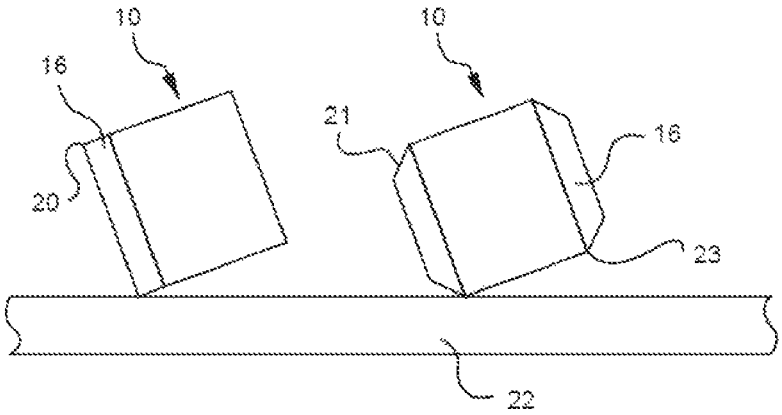
FIG. 5 illustrates embodiments of honeycomb filter bodies without a chamfered edge and with a chamfered edge.

FIG. 5 illustrates embodiments of a honeycomb filter body 10 without a chamfered edge 20 and with a chamfered edge 21. FIG. 5 illustrates that the honeycomb body without the chamfered edge exposes the softer after-applied skin material to a hard surface 22. Where the after-applied skin has been chamfered 21, the harder, fired and sintered honeycomb structure comes into contact with the surface 22, and therefore the honeycomb structure is less susceptible to edge chipping, flaking and cracking. FIG. 5 also shows that the chamfered edge of the after-applied skin, in an embodiment, originates at the intersection point of the after-applied skin and the end face of the honeycomb structure 23. In this configuration, the chamfer provides advantageous protection from chipping and flaking of the after-applied skin. If the chamfer does not extend entirely through the layer of after-applied skin 16, chipping and flaking may still occur in the after-applied skin layer. If the chamfered edge extends into the honeycomb structure itself, utility of the honeycomb filter may be lost. In other words, the end face of the matrix may not be chamfered, and may be at a 90° angle to the axial direction of the honeycomb structure.

The edge of the after-applied skin, at the end faces, can be chamfered. This can occur in a single step as after-applied skin is applied to the honeycomb body, or in a separate step after the application of after-applied skin. A chamfered edge can be formed on an after-applied skin of a honeycomb filter structure using a chamfering tool. The chamfering tool of the present invention can be in many configurations, including a knife, blade, sponge, wire, vibrating blade, vibrating wire, roller bar, plate, chamfering plate, chamfering blade, skin plate, chamfer-shaped press plate, press plate, grinder, sander or any other device suitable for forming an after-applied skin with an angled edge on a wet or hardened ceramic material. The chamfering tool can be rigid or deformable, shaped, contoured or flat. The chamfering tool can incorporate features to reduce pull residue. For example, the chamfering tool can be a chamfering plate with a nonstick surface or a release agent.

The chamfering tool can be rotatable about the honeycomb structure, or the chamfering tool can be stationary while the honeycomb structure is moved in relation to the chamfering tool.

Figure 6:
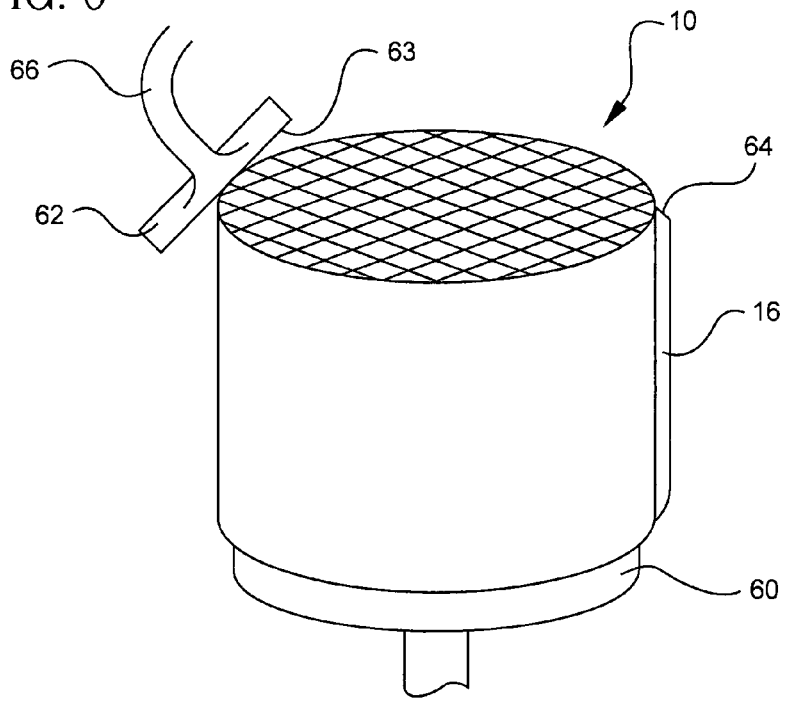
FIG. 6 illustrates an embodiment of the method of chamfering the edge of the after-applied skin of the present invention with a chamfering tool.

FIG. 6 illustrates an embodiment of a method of chamfering the edge of the after-applied skin of the present invention. A skinless honeycomb structure can be placed on a turntable 60, and an after-applied skin 16 can be applied to the exterior surface of the honeycomb filter structure (not shown). FIG. 6 illustrates an embodiment of a honeycomb filter body 10 with an after-applied skin 16 on a turntable 60. After an after-applied skin 16 has been applied to the exterior surface of the honeycomb filter body, a chamfered edge 64 can be created by placing a chamfering tool 62 with a chamfering surface 63 against the edge of the still-wet after-applied skin 16, at a desired angle, while rotating the honeycomb structure 10 on the turntable 60. As will be understood by those of skill in the art, wet ceramic material is deformable. The term "wet" for the purposes of this disclosure, means a ceramic material that has not been fired, dried, sintered, calcined or otherwise exposed to a treatment which causes the ceramic material to harden. In the embodiment illustrated in FIG. 6, the after-applied skin is chamfered at the end faces by swinging the chamfering tool 62, mounted on a swing arm 66, into position against the edge of the still-wet after-applied skin 16. The chamfering tool can be a blade, a squeegee, a sponge, a vibrating knife, or any other device suitable for forming an angled edge on a wet ceramic material. The edge-modified part can then be dried or otherwise treated according to methods known in the art.

In an alternative embodiment, the honeycomb ware as shown in FIG. 6, having an after-applied skin, can be dried or otherwise hardened. In this embodiment, the chamfering tool 62 can be a sanding or grinding tool to shape the hardened surface.

In another embodiment, the chamfered edge can be applied to an after-applied skin of a honeycomb filter structure where the honeycomb filter structure is not round. For example, the honeycomb filter structure can be oval, square, hexagonal, or other shapes. In this embodiment, the honeycomb filter structure with an after-applied skin can be placed on a turntable which is controlled by a controller, where the controller is programmed to move the turntable with respect to the chamfering tool as well as rotate the turntable so that the edge that is presented to the chamfering tool by the turntable on the controller is at a constant distance from the structure to be chamfered, regardless of the shape of the honeycomb filter structure. In another embodiment, the chamfering tool can be movable and programmable so that the chamfering tool can be moved with respect to a stationary honeycomb filter structure. For example, a chamfering tool can be mounted on a movable robotic arm where the movable robotic arm is programmed to bring the chamfering tool to the honeycomb filter structure and hold the chamfering tool at an appropriate angle, and move the robotic arm around the end faces of the honeycomb structure to create a chamfered edge on an after-applied skin of a honeycomb filter structure. The movable robotic arm can move around the honeycomb filter structure, creating a desired chamfered edge at the end-faces of the structure.

Figure 7:
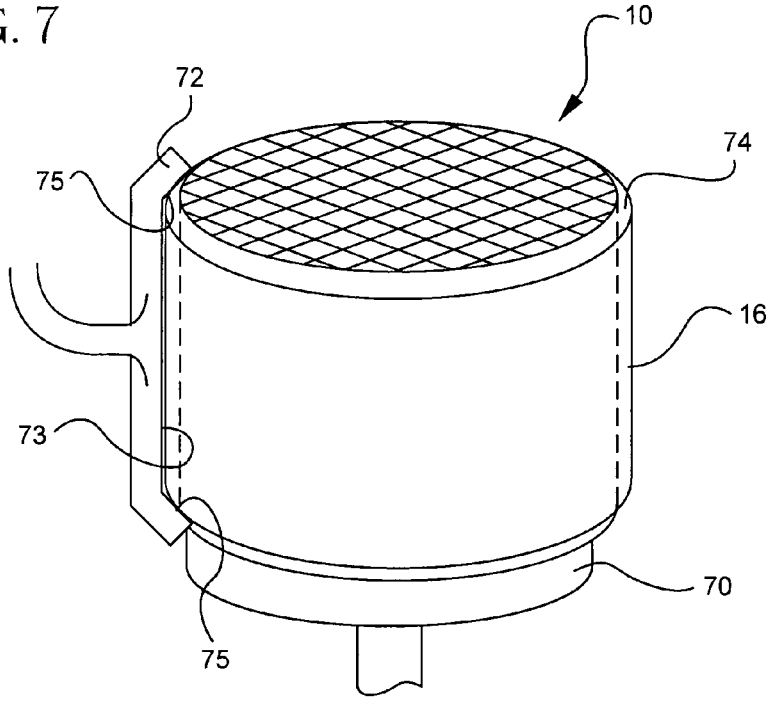
FIG. 7 illustrates another embodiment of the method of chamfering the edge of the after-applied skin of the present invention using a chamfering tool which has a substantially flat midsection and shaped ends.

In another embodiment, the after-applied skin can be applied, and the edges can be shaped or chamfered in a single step. FIG. 7 illustrates a chamfering tool 72 which has a substantially flat midsection 73 and shaped ends 75 at both ends. These shaped ends 75 are angled to provide a desired chamfer angle on the finished honeycomb structure, as shown in FIG. 7. While angled ends are shown in FIG. 7, it will be understood by those of skill in the art that the ends of the chamfering tool or chamfering blade can be any shape, including rounded, beveled, or other shapes which, when applied against a wet ceramic material, forms a chamfered surface. In this embodiment, after-applied skin material can be applied to the exterior surface of the honeycomb filter body, and a chamfered edge 74 can be created by placing the chamfering tool 72 against the honeycomb structure while rotating the honeycomb structure 10 on a turntable 70. In this embodiment, the after-applied skin 16 is applied to the honeycomb structure 10, and the after-applied skin is chamfered at the end faces in a single step. In an embodiment, the present invention includes a method of manufacturing a honeycomb filter structure having an after-applied skin with chamfered edges having steps including placing a skinless honeycomb structure on a turntable; placing a chamfering tool having a substantially flat midsection and angled ends adjacent to the skinless honeycomb structure; turning the turntable to rotate the honeycomb structure in relation to the chamfering tool while applying skin material between the surface of the rotating honeycomb structure and the chamfering tool, whereby a layer of skin material having a substantially flat midsection and shaped ends is applied to the honeycomb structure.

In an embodiment of the present invention, the edge of the after-applied skin can be chamfered while the after-applied skin is still wet. For example, before drying, the after-applied skin is pliable and easily shaped. For example, a honeycomb ceramic material can be extruded, fired and sintered, then contoured or shaped in a step which removes the skin of the honeycomb ceramic structure, and an after-applied skin can be applied to the length of the honeycomb filter body. In an embodiment, while still wet, a chamfering tool structured and arranged to form the preferred chamfer angle is held at the edge of the honeycomb filter body as the honeycomb filter body is rotated on a rotatable surface to form a chamfered edge. In another embodiment, the chamfering tool can be a plate upon which a honeycomb body sits as skin is applies to the outside of the honeycomb structure. When the plate has an inverse chamfer shape, or a chamfer lip, skin applied to the outside of the honeycomb structure will take on the shape of the plate, and a honeycomb structure with a chamfered after-applied skin layer is formed. In an embodiment, the chamfered edge is only applied to the after-applied skin and does not extend into the honeycomb filter body.

Figure 8:
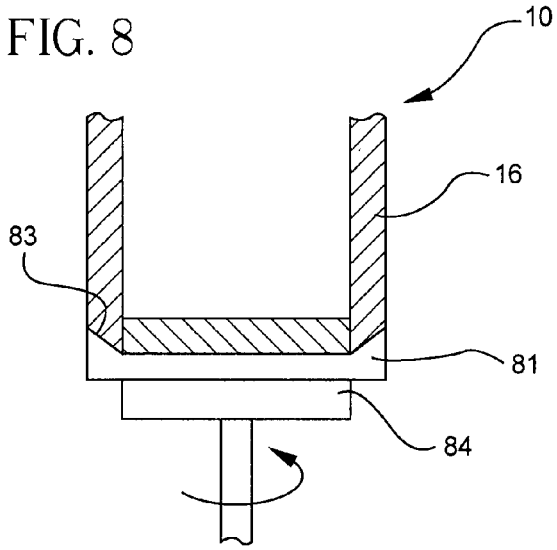
FIG. 8 illustrates another embodiment of the method of chamfering the edge of the after-applied skin of the present invention, where the chamfering tool is a chamfering plate with a chamfer lip.

FIG. 8 illustrates another embodiment of the method of chamfering the edge of the after-applied skin of the present invention. As shown in FIG. 8, a honeycomb structure 10 can be placed on a plate 81 with an inverted chamfer lip 83. When after-applied skin is applied to the exterior surface of the honeycomb body 10, resting on skin plate 81 with an inverted chamfer lip 83, a chamfered edge is formed on the after-applied skin 16 at the end face. This method can be used to chamfer the after-applied skin at one or both end faces of the honeycomb structure. In this embodiment, the chamfering tool is the plate 81 or skin plate 81. The plate 81 can be integral with a turntable, or can be a separate piece placed upon a turntable 84. Or, the plate 81 can be stationary.

Figure 9:
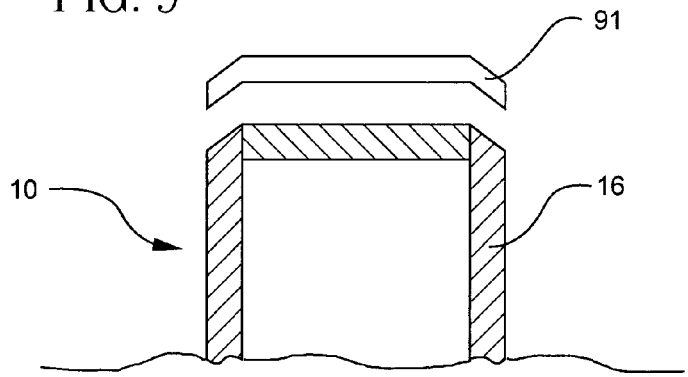
FIG. 9 illustrates another embodiment of the method of chamfering the edge of the after-applied skin of the present invention, where the chamfering tool is a chamfering plate which is pressed down onto a honeycomb ware to create a chamfered or shaped edge.
Figure 10:
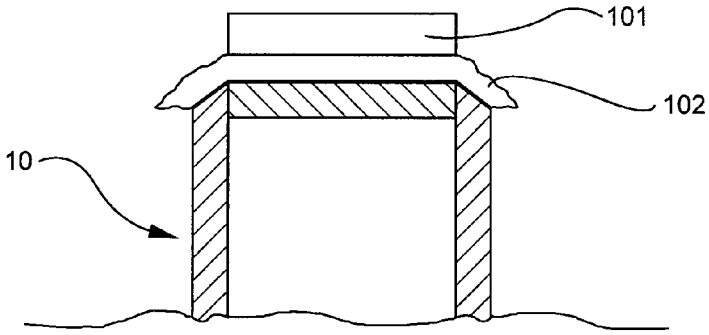
FIG. 10 illustrates an embodiment of the method of chamfering the edge of the after-applied skin of the present invention, where the chamfering tool is a chamfering plate with a deformable layer which is pressed onto a honeycomb ware to create a chamfered or shaped edge.

FIG. 9 illustrates another embodiment of the method of chamfering the edge of the after-applied skin of the present invention, whereby a chamfer-shaped plate 91, or press plate 91 is pressed onto wet skin 16, causing the wet skin 16 to take on the contour defined by the press plate 91. In this embodiment, the chamfering tool is the press plate. FIG. 10 illustrates another embodiment of the method of chamfering the edge of the after-applied skin of the present invention. As shown in FIG. 10, a shaping plate or press plate 101 can have a layer of deformable material 102, or can be pressed down against a layer of compressible material at the end-face of a honeycomb structure. Examples of deformable material include silicon or foam or any other suitable deformable material. The layer of deformable material 102 can be disposable, and can be interjected between the press plate and the honeycomb body at the chamfering step. Or, the layer of deformable material 102 can be integral with the press plate and can be used multiple times. The step of pressing this compressible deformable media down onto wet, deformable after-applied skin can cause the compressible media to be "squeezed out" between the press plate and the honeycomb structure. The spill-over of the compressible media 102 presses against the edges of the soft conformable after-applied skin, creating edges which are shaped or chamfered.

Figure 11:
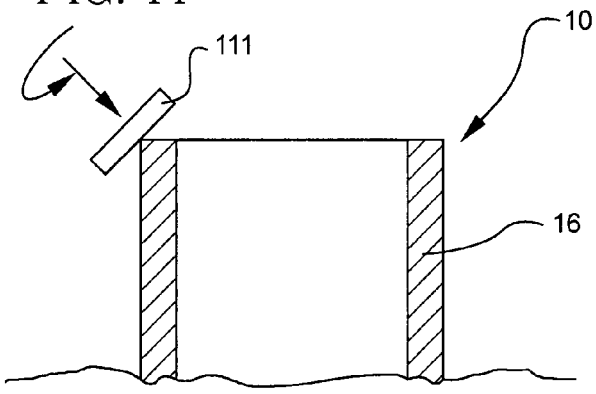
FIG. 11 illustrates a further embodiment of the method of chamfering the edge of the after-applied skin of the present invention, where the chamfering tool is a roller bar.

FIG. 11 illustrates another embodiment of the method of chamfering the edge of the after-applied skin of the present invention. As shown in FIG. 11, a chamfered or shaped edge can be formed by applying a rollable chamfering tool 111 to the edge of the honeycomb body 10. In this embodiment, a wet or conformable after-applied skin 16 can be shaped or chamfered by pressing a chamfering tool which is a rollable tool or a roller bar against the corner of the honeycomb body which has a deformable still-wet after applied skin at the end faces, and rolling the roller bar 111 around the honeycomb body. This tool can be applied against a honeycomb body that is mounted on a turntable, where the honeycomb body is moved in relation to a stationary roller bar 111, or the honeycomb body can be held stationary while a rollable chamfering tool such as a roller bar 111 is pressed against the honeycomb body at an appropriate angle, and the roller bar can swing around the honeycomb body, creating a chamfered or shaped edge. The roller bar 111 can be contoured or straight, and can be any shape to create the desired shaped edge.

Removing the chamfering tool from the shaped honeycomb structure may leave undesired artifact. For example, pulling the chamfering plate of FIG. 8, 9 or 10 away from the honeycomb structure may pull some of the wet after-applied skin material and leave behind pull residue on the honeycomb structure. Turning in particular to FIG. 10, when compressible material is pressed against wet after-applied skin material, and then the wet compressible material is pulled away, the removal of the compressible material may cause the wet after-applied skin material to pull away and deform. For the purposes of this application for patent, "pull residue" or "lip pullup" means deformation of the honeycomb body or skin caused by the removal of a shaping tool from the surface of the structure. This pull residue can be removed by further shaping steps, including cutting, smoothing, grinding or polishing, or any other technique or combination of techniques well known in the art.

Figure 12:
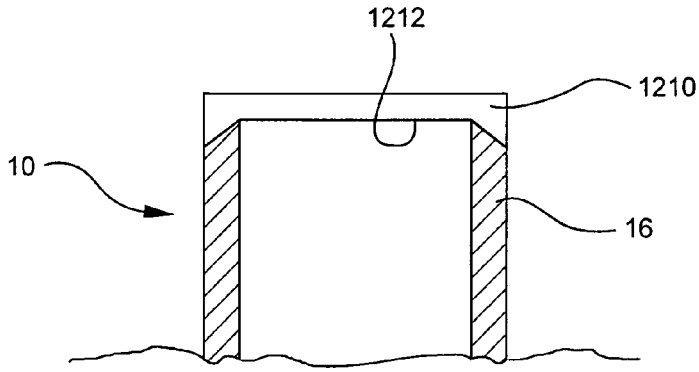
FIG. 12 illustrates embodiments of a method for removing a chamfering tool from a honeycomb structure to reduce pull residue.

FIG. 12 illustrates embodiments of a method for removing a plate 1210 from a honeycomb structure 10 to reduce pull residue. In one embodiment, FIG. 12 illustrates removing a plate 1210 from a honeycomb structure 10 by rotating the plate of FIG. 8, FIG. 9 or FIG. 10 in relation to the shaped honeycomb structure. This rotation will act to break adhesion forces between the wet skin material and the plate, and will reduce pull residue. FIG. 12 also illustrates that the plate 1210 can have a nonstick layer or a layer of release material 1212 to reduce pull residue. A nonstick layer may be formed from polytetrafluoroethylene (PTFE or Teflon®), ultra high molecular weight polyethylene (UHMW), or other known materials suitable for the purpose. A release layer may include a sprayed on or introduced layer of release material such as silicon, starch, or oil. The release material may need to be replenished each time a part is chamfered Where the honeycomb body has been fired prior to the application of an after-applied skin, and it is not desirable to expose the fired sintered honeycomb body to another high-temperature firing, it may be desirable to expose an after-applied skin to a drying step by exposing the honeycomb body with an after-applied skin to temperatures that are not as severe as those used for a firing/sintering step, for example, temperatures below 300° C.

Figure 13:
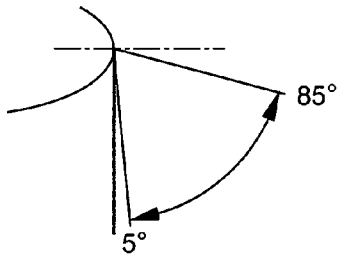
FIG. 13 illustrates the range of acceptable angles of chamfer that may be preferable in embodiments of the present invention.

The chamfered edge of the after-applied skin can be any shape including rounded, beveled, triangular, etc. Optionally, the chamfered edge may be touched up with an implement such as a sander, grinder or doctor blade to perfect the chamfered edge of the after-applied skin. FIG. 13 illustrates the range of acceptable angles of chamfer that may be preferable in embodiments of the present invention. The angle of the chamfer may be, for example, between 5 and 85 degrees or between 15 and 75 degrees.

The foregoing description of the specific embodiments reveals the general nature of the invention that others can, by applying knowledge within the skill of the art, readily modify and/or adapt for various applications such specific embodiments, without undue experimentation and without departing from the general concept of the present invention. Such adaptations and modifications, therefore, are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A method of manufacturing a honeycomb structure, comprising the steps of:

providing a honeycomb body having a multiplicity of cells extending therethrough between opposing end faces, said cells being defined by intersecting porous walls;

applying a wet after-applied skin layer on the honeycomb body; and then after-applying the wet after-applied skin layer, chamfering an edge of the wet after-applied skin layer at at least one end face.

2. The method of claim 1 further comprising contouring the honeycomb body before applying the after-applied skin layer.

3. The method of manufacture of claim 1 wherein the chamfering step is performed by applying a chamfering tool against an edge of the wet after-applied skin while rotating the honeycomb body.

4. The method manufacture of claim 3 wherein the chamfering tool is a contoured or straight, rigid or deformable blade or plate, or a contoured or straight roller bar.

5. The method of manufacture of claim 1 wherein the chamfered edge is at an angle between 5 and 85 degrees.

6. The method of manufacture of claim 1 wherein the chamfered edge is at an angle between 15 and 75 degrees.

7. The method of manufacture of claim 1 wherein the chamfered edge is rounded.

8. The method of manufacture of claim 1, wherein the edge of the after-applied skin is chamfered by pressing the honeycomb structure with the after-applied skin against a press plate.

9. The method of manufacture of claim 8 wherein the press plate comprises deformable material.

10. The method of manufacture of claim 8 further comprising removing the press plate from the honeycomb structure after chamfering the edge of the after-applied skin.

11. The method of manufacture of claim 10 wherein the press plate is rotated.

12. The method of manufacture of claim 1, further comprising the steps of placing the honeycomb body with the after-applied skin on a turntable and rotating the honeycomb body with the turntable while a chamfering tool chamfers the edge of the wet after-applied skin layer.

13. The method of manufacture of claim 12 wherein the chamfering tool is a rigid or flexible blade, sponge, wire, vibrating blade, vibrating wire, roller bar, plate, chamfering plate, chamfering blade, skin plate, chamfer-shaped plate or a press plate, wherein the chamfering tool can be shaped or straight.

14. The method of manufacture of claim 12 wherein the chamfering tool is deformable.

15. The method of manufacture of claim 12 wherein the chamfering tool is integral to the turntable.

16. The method of manufacture of claim 12 wherein the chamfering tool comprises a non-stick or release material.

17. A method of manufacturing a honeycomb structure, comprising the steps of:

providing a honeycomb body having a multiplicity of cells extending therethrough between opposing end faces, said cells being defined by intersecting porous walls;

applying a wet after-applied skin layer on the honeycomb body;

chamfering an end-face edge of the wet after-applied skin layer while the after-applied skin layer is in a still-wet condition before beginning a process of drying;

and then, after the step of chamfering is complete, beginning the process of drying the wet after-applied skin layer.

18. The method of manufacture of claim 17, further comprising a step of drying the honeycomb body before applying the wet after-applied skin layer to the honeycomb body.

19. The method of manufacture of claim 18, further comprising a step of firing the honeycomb body after drying the honeycomb body and before applying the wet after-applied skin layer to the honeycomb body.

20. The method of claim 17 further comprising contouring the honeycomb body before applying the wet after-applied skin layer.

21. The method of manufacture of claim 17 wherein the chamfering step is performed by applying a chamfering tool against an edge of the wet after-applied skin while rotating the honeycomb body.

22. The method manufacture of claim 21 wherein the chamfering tool is a contoured or straight, rigid or deformable blade or plate, or a contoured or straight roller bar.

23. The method of manufacture of claim 17 wherein the chamfered edge is rounded.

24. The method of manufacture of claim 17, wherein the edge of the after-applied skin is chamfered by pressing the honeycomb structure with the after-applied skin against a press plate.

25. The method of manufacture of claim 24 further comprising a step of removing the press plate from the honeycomb structure after chamfering the edge of the after-applied skin, wherein the press plate is rotated relative to the honeycomb structure during the step of removing the press plate.

26. The method of manufacture of claim 17, further comprising steps of placing the honeycomb body with the after-applied skin on a turntable and rotating the honeycomb body with the turntable while a chamfering tool chamfers the edge of the wet after-applied skin layer.

* * * * *